US007421874B2

(12) United States Patent
Claasen et al.

(10) Patent No.: US 7,421,874 B2
(45) Date of Patent: Sep. 9, 2008

(54) MAIN CYLINDER OR PRESS CYLINDER OF AN EXTRUSION/TUBE EXTRUSION PRESS

(75) Inventors: Karl Hermann Claasen, Moers (DE); Uwe Muschalik, Duisburg (DE)

(73) Assignee: SMS Eumuco GmbH, Leverkusen (DE)

( * ) Notice: Subject to any disclaimer, the term of this patent is extended or adjusted under 35 U.S.C. 154(b) by 268 days.

(21) Appl. No.: 10/524,644

(22) PCT Filed: Aug. 5, 2003

(86) PCT No.: PCT/DE03/02621

§ 371 (c)(1),
(2), (4) Date: Jan. 5, 2006

(87) PCT Pub. No.: WO2004/018120

PCT Pub. Date: Mar. 4, 2004

(65) Prior Publication Data

US 2006/0101886 A1 May 18, 2006

(30) Foreign Application Priority Data

Aug. 8, 2002 (DE) ..... 102 36 297

(51) Int. Cl.
*B21C 23/00* (2006.01)

(52) U.S. Cl. ..... 72/253.1; 72/264; 72/453.01; 72/453.16

(58) Field of Classification Search ..... 72/253.1, 72/264, 265, 266, 268, 271, 273.5, 453.01, 72/453.02, 453.14, 453.18
See application file for complete search history.

(56) References Cited

U.S. PATENT DOCUMENTS

| | | | | |
|---|---|---|---|---|
| 3,201,966 | A * | 8/1965 | Benteler et al. | 72/264 |
| 3,243,984 | A * | 4/1966 | Hoffmann et al. | 72/255 |
| 3,355,927 | A * | 12/1967 | Sibler | 72/261 |
| 4,084,422 | A * | 4/1978 | Zilges et al. | 72/373.5 |
| 6,082,162 | A * | 7/2000 | Muschalik et al. | 72/253.1 |

FOREIGN PATENT DOCUMENTS

| | | | |
|---|---|---|---|
| EP | 0706843 | | 4/1996 |
| FR | 2154971 | * | 5/1973 |

* cited by examiner

*Primary Examiner*—Edward Tolan
(74) *Attorney, Agent, or Firm*—Andrew Wilford

(57) ABSTRACT

A press cylinder for an extrusion press having a cylinder beam has a cylinder housing fixed on the beam and a piston shiftable along an axis in opposite forward and rearward directions in the housing and defining with a rear end of the housing a pressurizable cylinder chamber. A rod projecting axially rearwardly through the rear wall of the housing is formed with an axially extending bore. A connection block is fixed on the housing rearward of the piston. An axially extending tube in the bore fixed to the block is surrounded by an axially extending sleeve forming with the tube an annular gap, forming with an inner surface of the bore an annular compartment, and also fixed to the block. This is formed with respective passages opening into the tube and into the annular gap.

8 Claims, 1 Drawing Sheet

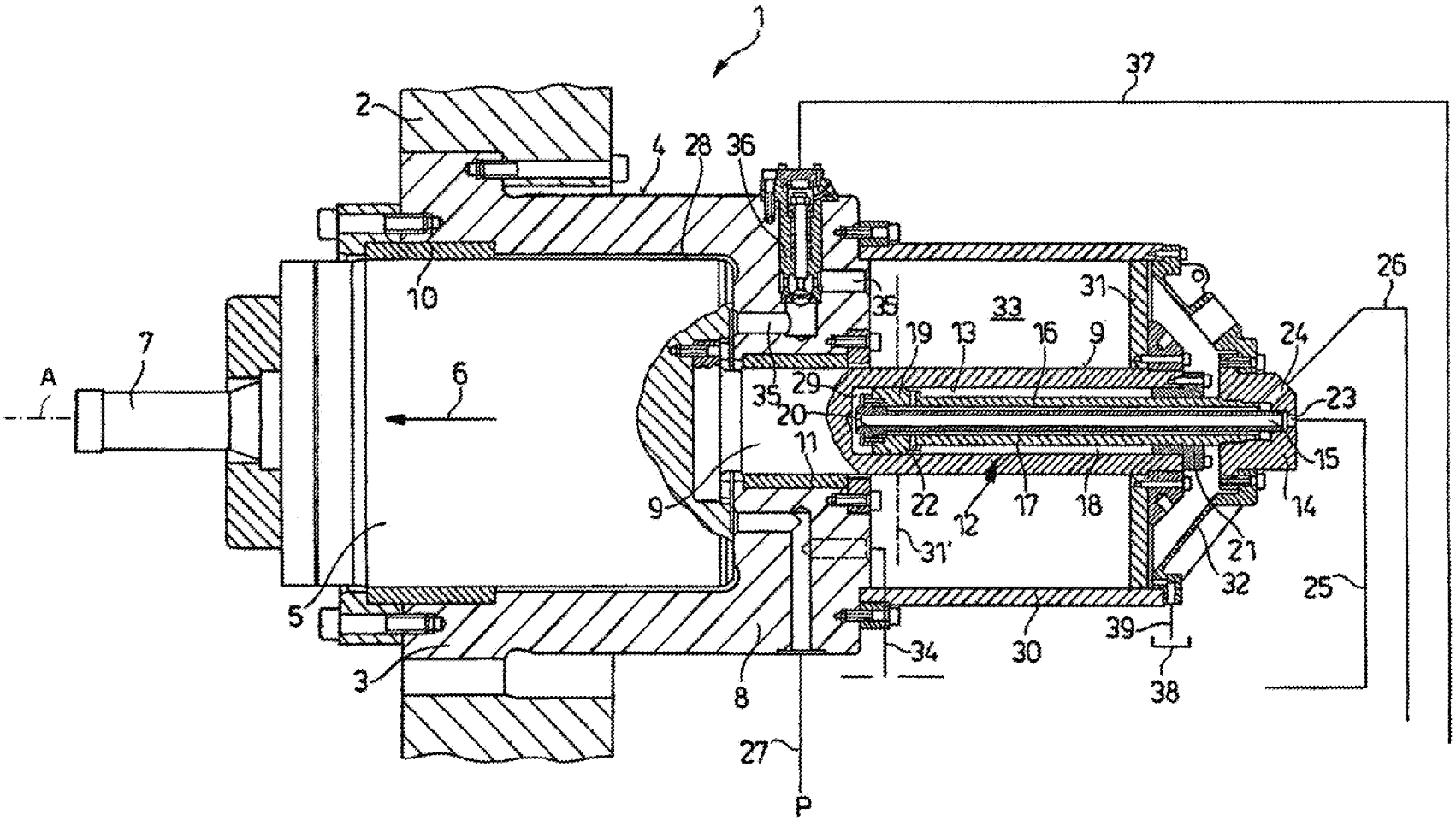
1
2
3
4
5
6
7
8
9
10
11
12
13
14
15
16
17
18
19
20
21
22
23
24
25
26
27
28
29
30
31
31'
32
33
34
35
36
37
38
39
P
A

MAIN CYLINDER OR PRESS CYLINDER OF AN EXTRUSION/TUBE EXTRUSION PRESS

CROSS REFERENCE TO RELATED APPLICATIONS

This application is the US national phase of PCT application PCT/DE2003/002621, filed 5 Aug. 2003, published 4 Mar. 2004 as WO 2004/018120, and claiming the priority of German patent application 10236297.1 itself filed 8 Aug. 2002, whose entire disclosures are herewith incorporated by reference.

FIELD OF THE INVENTION

The invention relates to a main cylinder or press cylinder [compression cylinder] of a pipe or tube press and extrusion press which is mounted in a cylinder beam [traverse] and which has a press piston in its cylinder housing connected with a rod which projects from the cylinder housing.

BACKGROUND OF THE INVENTION

A tube or extrusion press configured as a frameless metal extrusion press in which the rod of the press piston is configured as a piston rod, which are located at positions normally occupied by tension rods or columns of the usual press frame and which are connected with the counterbeam, is known from DE 198 35 717 (U.S. Pat. No. 6,082,162) with two such main press cylinders. In order to achieve a high degree of operating efficiency and to minimize dead time, both the take up of the play and the retraction should be carried out with the greatest possible speed, which requires high volumetric flow of the fluids involved. The main cylinders are thus configured with approximately the same stroke volume to both sides of the main press piston and a switchable connection is provided between the partial cylinder compartments on the two sides.

To press a blank, the press piston of the press cylinder supported by the cylinder beam is pressurized and for this purpose the piston rod of the press piston must extend to and be connected with the traveling beam. The press piston with its piston rod is bored to form a passage over a part of the length to constitute a cylinder bore in which a plunger piston extends, the latter being braced against a cover closing the cylinder. The pressurization of the plunger piston allows retraction of the press piston and with it via the piston rod, the traveling beam into the starting position. Further piston and cylinder units are braced against a base frame of this press in order to enable the traveling beam to be displaced over the play or nonload portion of its stroke in a rapid movement.

Apart from the fact that this metal extrusion press brings with it a certain significant expense, numerous components must be mounted on the counterbeam to permit the main cylinder with its piston rod to connect to the traveling beam. This has been found to limit the working range of the metal extrusion press above all in cases in which the extrusion press profile or cross section is not straight but in which the extrusion press profile should be produced with curvatures or radii in different directions (compare EP 0 706 843 B1).

OBJECT OF THE INVENTION

The invention thus has as its object to provide a main or press cylinder of the type described at the outset which, while retaining a short-circuiting flow technique for rapid movement, enables in a simpler manner a rapid transfer of the pressurizing oil from one to another compartment, thereby simultaneously reducing the structural cost and permitting a press construction which admits of a sufficiently large free space ahead of the counterbeam that extrusion products with radii or curvatures can be produced in an unhindered manner.

SUMMARY OF THE INVENTION

These objects are achieved according to the invention in that the rod is configured with an integrated forward drive and retraction cylinder and in an axial passage or bore thereof a telescoping or sword-like tube is received with formation of a pressurizable compartment connected via an annular gap with the pressurizable compartment in a flow path. The annular space is surrounded concentrically by an elongated sleeve housing and the sword-like tube together with the sleeve housing at an end projecting from the rod is held stationary in a hydraulic connecting element which has a fluid connection or feeding opening into the telescoping tube and a connecting opening or fitting opening into the annular gap. The rod is configured according to the invention differently than with the known configuration as a forward drive and retraction cylinder so that the otherwise conventional lateral cylinders are eliminated and simultaneously a more rapid forward drive and retraction of the press cylinder is achieved. For this purpose the pressurized oil head is so controlled or reversed with the known hydraulic means that it can give rise to a rapid advance by means of the telescoping tube and the compartment lying forwardly thereof in the axial bore of the rod or to a rapid retraction through the pressurizable compartment and then through the annular gap whereby the pressurization of the press piston in these directions are correspondingly supported by these additional oil quantities.

As to the configuration of the forward advance and retraction cylinder in the rod, the invention provides that the bore be sealed against the sleeve housing by a packing which rides on the housing sleeve upon pressurization and which is fixed piston-like at the end of the rod and engages into the pressurizable compartment. Upon pressurization of the press piston in its working stroke, this rod seal delimiting the pressurizable compartment rearwardly slides upon the telescoping tube which together with the sleeve housing are held stationary, into its forward end position. When the unit is switched over to retraction, the pressurized oil flowing into the pressurizable compartment via the annular gap is effective upon the rod seal.

According to an embodiment of the invention, the end of the telescoping tube lying in the bore is configured with an enlarged head sealing the annular gap, this head fastening the telescoping tube with the sleeve housing in such manner that at this end a radial seal is formed by a collar against the inner surface of the bore. This ensures that for the rapid forward displacement of the press piston, the additional pressurized oil fed through the telescoping tube can pass into the pressurized compartment defined in the axial bore of the rod but not however into the annular gap or the pressurized compartment between the housing sleeve and the rod in the case of a rapid retraction. The passage of the pressurized oil which is additionally supplied, to locations other than through the annular gap into the pressurizable compartment between the housing sleeve and the rod is excluded.

The sealed radial collar of the sleeve is advantageously provided for the simultaneous flow connection of the annular gap with the pressurizable compartment between the housing sleeve and the inner surface of the axial bore of the rod in that, according to the invention, an annular gap is provided in the radial collar at the bores connected to the pressure compartment.

According to an advantageous construction of the invention, the cylinder chamber of the main cylinder housing is formed with a guide for the press piston and, the cylinder housing bottom is formed with a guide for the rod. As a consequence a support traverse used for the press ram can be eliminated since the ram as well as the press piston can be cantilevered toward the counterbeam of the extrusion press. As a result there is in total a two point guiding of the press piston and its rod, in one case in the region of the front of the cylinder and in the other case in the region close to the total thickness of the cylinder housing bottom for the rod.

Thus a construction of the tube and extrusion press or metal extrusion press is contemplated in which the configuration of the forward drive and retraction cylinder extends away from the counterbeam and rearwardly of the cylinder beam and the position of the rod is such that in the working compartment between the cylinder beam and the counterbeam of the press there are no unnecessary components which may be detrimental and can interfere with the working range and in addition lateral cylinders as well as a traverse for the ram itself can be completely omitted.

A further feature of the invention or solution to the objects set forth, in accordance with the invention is a tube and extrusion press in which the free forwardly projecting or counterlevered end of the rod is enclosed in an equalizing or compensating chamber affixed to the main cylinder housing and in which, upon pressurization of the press cylinder has a slider which is sealed with respect to the inner surface of the container and slides on the rod end removed from the main cylinder housing, whereby compartment formed between the rod and the compensating chamber is closed at its end by the slider and opens from the point of view of flow at the cylinder compartment lying behind the press piston at which a pressurized oil duct opens.

It is thus advantageously provided that the compartment of the compensating chamber is connected to the tank conduit and preferably is arranged in a switchable blocking valve in the connecting line communicating with the cylinder housing bottom and which runs from that compartment to the cylinder compartment behind the press piston. In this manner, upon the advance of the press piston into its working position, the open blocking valves, four of which can be provided, configured as two-way valves built into the apparatus or also as logic controlled valves or cartridge valves, can be used to control the flow from the chamber of the compensating chamber of the supplied oil when the press piston, which has the same diameter as the compensating chamber, has reached its working position and is about to begin a press operation. The connecting lines can be closed by means of the blocking valves so that the slider displaces the remaining oil quantity in the compensating chamber only back to the tank while the associated pressurization with oil under pressure will not suck back oil so that the tank can be spaced at a goodly distance from the press and be connected thereto by the oil pressure lines. The oil lines need not, therefore, be of particularly large cross section as is the case where a compensating chamber is not provided at the end of the press stroke and upon reversal of the hydraulic control unit to initiate the retraction phase of the press piston back to its starting position in the cylinder housing, the flow flows back into the compensating cylinder, that is the oil in operation of the pipe or extrusion press is shifted back and forth under pressure.

The mode of operation with a compensating chamber is especially suitable in combination with the rod with its integrated forward drive and retraction cylinder of the above-described type because then no lateral cylinder is required for the forward and rearward movement.

BRIEF DESCRIPTION OF THE DRAWING

Further features in detail of the invention are given in the following description whose sole FIGURE shows a construction in which the press piston rod is surrounded by an equalizing vessel and the rod has an integrated forward drive and retraction cylinder in accordance with an embodiment of the invention.

SPECIFIC DESCRIPTION

The extrusion press 1 according to the invention has a cylinder beam 2 only one of which can be seen in the drawing and in which a cylinder housing 3 is mounted to form a main or press cylinder 4. The cylinder beam 2 lies in the plane of the view and to the left thereof is juxtaposed with an unillustrated tool (press plate, die holder and die) fitted onto a counterbeam. The cylinder housing 3 holds a press piston 5 that at its front end in a press direction 6 is provided with a press ram 7 which, upon pressurization of the press piston 5, presses a metal block which has been loaded into the receiver through the tool or die of the unillustrated counterbeam. At the other, rear end, the press piston 5 is attached by screws to a rod 9 that extends rearwardly through a rear end 8 of the cylinder housing 3. The unit formed by the press piston 5 and the rod 9 are guided without play in a fully determined manner, namely, in a first guide 10 for the press piston 3 and second guide 11 for the piston rod 9 in the cylinder housing rear end 8.

The rod 9 is integrated with a forward drive and retraction cylinder 12. For this purpose a bore 13 extending along an axis A and provided in the rod 9 and a fixed hydraulic connection block 14 hold a telescoping or sword-shaped tube 15 and a housing sleeve 17 concentric and defining an annular gap 16 therewith. The housing sleeve 17 defines a pressure chamber 18 with an inner surface of the bore 13. The ends of the housing sleeve 17 and the telescoping tube 15 extend into the axial bore 13 of the rod 9 and are guided with a thickened head 20 in a radial collar 19 sealed against the inner surface of the bore 13, the thickened head 20 sealing the end of the annular gap 16. At the rear free end, the pressure chamber 18 is sealed by a packing 21 that slides along the outer surface of the housing sleeve 17 during movement of the pressing piston 5 in its forward and rearward strokes and that is connected by screws to the rod 9. To establish a flow between the pressure chamber 18 and the annular gap 16, bores 22 are machined into the radial collar 19 of the housing sleeve 17.

The hydraulic connecting block 14 has a pipe connection or fitting 23 opening into the telescoping tube 15 and a pipe connection or fitting 24 opening into the annular gap 16 and connected with an oil supply not shown and with a conventional hydraulic unit for the switchover of hydraulic fluid flow.

For rapid movement of the press piston 5 into a working position in the press direction 6, that is to bring the ram 7 up against the blank to be forced through the die,] oil flows from the oil supply through a pressurized oil duct 27 into the cylinder chamber 28 behind the press piston 5 and simultaneously through the conduit 25 and the connection 23 into the telescoping tube 15 so that this additional oil quantity flows into a pressure chamber 29 axially in front of the radial collar 19 and the thickened head 20 in the bore 13 and supports the forward stroke. As soon as the press piston 5 has reached its pressing position, the oil supply through the conduit 25 to the telescoping tube 15 is blocked and the working pressure is applied only via the pressurized oil line 27 to the chamber 28].

For retraction or backward movement of the press piston 5 into its starting position shown in the drawing, oil is drained the hydraulic control unit out of the cylinder chamber 28 and the pressure chamber or compartment 29 and, simultaneously, oil is pumped through the conduit 26 and the connection 24 to the annular gap 16 from which it is distributed by the bores 22 into the pressurizable compartment 18 to retract the press piston 5 by acting on the packing 21.

The embodiment shown in the drawing indicates further that the integrated forward drive and retraction cylinder and rod 9 are combined further with a compensating chamber 30 attached by screws to the cylinder housing bottom 8. The compensating chamber is closed at its rear end by a slide plate 31 fixed on the rod 9 and whose outer periphery is sealed against and slides along the inner surface of the vessel during the piston strokes. The hydraulic connecting block 14 for the integrated forward drive and retraction cylinder 12 of the rod 9 is attached by screws to a bell 32 which, on its part, is attached by screws to the rear end of the compensating chamber 30. A compartment 33 enclosed between the compensating chamber 30 and the rod 9 and between the cylinder housing bottom 8 and the slider 13 contains oil which, from that compartment, flows either into the cylinder chamber 28 behind the press piston 5 through connecting passages 35 provided in the cylinder housing bottom 8 or through a tank conduit 34 into a tank or in the opposite direction for pressurization in the opposite sense and thus is moved back and forth.

During forward movement of the press piston 5 into its operating or pressing mode, switchable blocking valves 36 of cartridge construction and arranged in the connecting passages 35 are in their open operating positions so that oil can be displaced from the chamber 33 by the slider 31 under pressure into the cylinder or plunger chamber 28. In the press position, the blocking valves 36, of which a total of four are provided, are closed by the hydraulic control unit via control lines 37 and the pressurizable oil for the actual extrusion is supplied only via the pressurized oil conduit 27 to the cylinder chamber 28 through the tank line 34 which remains open during this operating phase. The slider 31 displaces the residual oil remaining in the compartment 33 into the tank as the slider 31 is moved during the press stroke in the forward press direction 6. The end position assumed by the slider 31 at the conclusion of the press or working stroke has been shown in a dot dash line at 31'.

During rearward movement of the press piston 5 into the starting position shown in the drawing, by reversal of the control and flow directions, corresponding flow paths are opened so that the compartment 33 of the compensating chamber 30 can again be filled with the starting quantity of oil. The rapid movements for the forward and retraction stroke are then effected in the above-described manner with the forward drive and retraction cylinder 12 integrated in the rod 9. For possible leakage, a leakage oil conduit 39 leading to a tank 38 is provided rearward of the slide 31.

The invention claimed is:

1. In an extrusion pressing having a cylinder beam, a press cylinder comprising:

a cylinder housing fixed on the beam;

a piston shiftable along an axis in opposite forward and rearward directions in the housing and defining with a rear end of the housing a pressurizable cylinder chamber;

a rod projecting axially rearwardly through the rear wall of the housing and formed with an axially extending bore;

a connection block fixed on the housing rearward of the piston;

an axially extending tube in the bore fixed to the block;

an axially extending sleeve in the bore surrounding the tube, forming with the tube an annular gap, forming with an inner surface of the bore an annular compartment, and also fixed to the block, the connection block being formed with respective passages opening into the tube and into the annular gap; and a head fixed to the tube and to the sleeve, slidable in the bore, and forwardly closing the tube, the annular gap, and the annular compartment.

2. The main or press cylinder according to claim 1 wherein the bore is sealed with a piston-like packing against the sleeve along which the packing slides at the end of the rod upon application of fluid pressure.

3. The main or press cylinder according to claim 1 wherein bores in the head connect the annular compartment with the annular gap.

4. The main or press cylinder according to claim 1 wherein the cylinder chamber of the housing has a guide for the piston and a rear end of the cylinder housing is configured with a guide for the rod.

5. In an extrusion pressing having a cylinder beam, a press cylinder comprising:

a cylinder housing fixed on the beam;

a piston shiftable along an axis in opposite forward and rearward directions in the housing and defining with a rear end of the housing a pressurizable cylinder chamber;

a rod projecting axially rearwardly through the rear wall of the housing and formed with an axially extending bore;

a connection block fixed on the housing rearward of the piston;

an axially extending tube in the bore fixed to the block;

an axially extending sleeve in the bore surrounding the tube, forming with the tube an annular gap, forming with an inner surface of the bore an annular compartment, and also fixed to the block, the connection block being formed with respective passages opening into the tube and into the annular gap; and a head fixed to the tube and to the sleeve, slidable in the bore, and forwardly closing the tube, the annular gap, and the annular compartment;

a chamber between the rear end of the housing and the connection block and through which the rod extends;

a slide plate fixed on the rod, shiftable with the rod and piston in the chamber, and defining a compensating chamber between the slide plate and the rear end of the housing; and means opening into the compensating chamber for pressurizing same and urging the slide plate, rod, and piston axially rearward.

6. The main or press cylinder according to claim 5, further comprising a tank conduit connected to the compensating.

7. The main or press cylinder according to claim 5 wherein the rear wall is formed with connecting passages communicating between the compensating chamber and the cylinder chamber and provided with closable blocking valves.

8. In an extrusion pressing having a cylinder beam, a press cylinder comprising:

a cylinder housing fixed on the beam;

a piston shiftable along an axis in opposite forward and rearward directions in the housing and defining with a rear end of the housing a pressurizable cylinder chamber;

a rod projecting axially rearwardly through the rear wall of the housing and formed with an axially extending bore;

a connection block fixed on the housing rearward of the piston;

an axially extending tube in the bore fixed to the block;

an axially extending sleeve in the bore surrounding the tube, forming with the tube an annular gap, forming with an inner surface of the bore an annular compartment, and also fixed to the block, the connection block being formed with respective passages opening into the tube and into the annular gap; and a head fixed to the tube and to the sleeve, slidable in the bore, and forwardly closing the tube, the annular gap, and the annular compartment;

a chamber between the rear end of the housing and the connection block and through which the rod extends;

a slide plate fixed on the rod, shiftable with the rod and piston in the chamber, and defining a compensating chamber between the slide plate and the rear end of the housing, the rear wall formed with a connecting passage extending between the cylinder chamber and the compensating chamber;

a closable valve in the connecting passage; and means opening into the compensating chamber for pressurizing same and urging the slide plate, rod, and piston axially rearward.

* * * * *